US006820593B2

(12) United States Patent
Remele et al.

(10) Patent No.: US 6,820,593 B2
(45) Date of Patent: Nov. 23, 2004

(54) REGULATION OF TRUE RUNNING FOR DIESEL ENGINES

(75) Inventors: Joerg Remele, Hagnau (DE); Andreas Schneider, Friedrichshafen (DE); Albrecht Debelak, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 91 days.

(21) Appl. No.: 10/169,611

(22) PCT Filed: Nov. 2, 2001

(86) PCT No.: PCT/EP01/12697

§ 371 (c)(1),
(2), (4) Date: Oct. 22, 2002

(87) PCT Pub. No.: WO02/38936

PCT Pub. Date: May 16, 2002

(65) Prior Publication Data

US 2003/0089338 A1 May 15, 2003

(30) Foreign Application Priority Data

Nov. 7, 2000 (DE) ..... 100 55 192

(51) Int. Cl.[7] ..... F02M 7/00
(52) U.S. Cl. ..... 123/436; 123/481
(58) Field of Search ..... 123/436, 481, 123/406.24, 406.23; 73/117.3

(56) References Cited

U.S. PATENT DOCUMENTS 6,021,758 A 2/2000 Carey et al.
6,082,187 A * 7/2000 Schricker et al. ..... 73/116
6,209,519 B1 * 4/2001 Melchior et al. ..... 123/406.24
6,546,912 B2 * 4/2003 Tuken ..... 123/436
6,668,812 B2 * 12/2003 Javaherian ..... 123/673

FOREIGN PATENT DOCUMENTS

| | | |
|---|---|---|
| DE | 4122139 A1 | 1/1993 |
| DE | 19548604 C1 | 2/1997 |
| WO | WO 97/23716 | 7/1997 |
| WO | WO 98/07971 | 2/1998 |
| WO | WO 00/36287 | 6/2000 |

OTHER PUBLICATIONS

Jochen Tonndorf, "Einfluß des Aussetzerbetriebes auf das Drehschwingungsverhalten von Antriebsanlagen mit Kolbenmotoren" , Nov. 30, 1981, pp. 1–109.

* cited by examiner

*Primary Examiner*—Mahmoud Gimie
(74) *Attorney, Agent, or Firm*—Crowell & Moring LLP

(57) ABSTRACT

Contributions of individual cylinders of the internal-combustion engine to the rotational acceleration are determined by the rotational speed course of the crankshaft by individually cutting off the cylinders successively. From the thus obtained rotational speed course curves, a pulse response spectrum $\vec{I}$ of an operating cycle is formed at least for the harmonic of the 0.5th order. In normal operation, the rotational speed course of the crankshaft is then continuously recorded above the angle of each operating cycle. By a Fourier transformation, Fourier coefficients are determined as a resultant $\vec{R}$ at least of the harmonic of the 0.5th order. Correction factors for the injection quantities are obtained for equalization of the individual cylinders with respect to their rotational speed fractions. The components of the resultant $\vec{R}$ situated in the direction of the pulse response vectors are multiplied with the pulse responses $\vec{I}$ and are combined by addition.

31 Claims, 3 Drawing Sheets

REGULATION OF TRUE RUNNING FOR DIESEL ENGINES

The present invention relates to a method of controlling smooth running such as that known, for example, from German Patent Document DE 195 48 604 C1. The known method is used for determining differences of the torque contributions of individual cylinders of an internal-combustion engine by means of the course of the rotational crankshaft speed. This method is based on a recognition that the rotating movement of the crankshaft takes place in an irregular manner under the effect of gas forces and forces of gravity. In order to determine the rotational-speed fraction or torque fraction of a cylinder, individual cylinders are cut off in a targeted manner during engine operation. By means of a comparison with the rotational speed course of the engine operated without a cylinder cut-off, the torque fraction of each individual cylinder in the overall engine torque can be illustrated separately by means of a rotational speed signal. The injection quantity spreadings caused by manufacturing tolerances are recognized and are to be compensated for by establishing the same average pressures in all cylinders by the variation of injection quantities.

A similar method is described in German Patent Document DE 41 22 139 C2. This method is also based on the fact that cyclic irregularities occur; these cyclic irregularities are caused by the different quantities of fuel injected into the individual cylinders of the internal-combustion engine because of tolerances in the injection devices. The starting point is the fact that the torque or the rotational acceleration is directly proportional to the injected fuel quantity. In order to avoid rotational speed irregularities, the fraction of each combustion process in the rotational acceleration is detected. The measured values are compared with one another by forming average values, and deviations are determined in this manner. The fuel injection quantities of the individual cylinders are finally changed such that the deviations disappear. The sum of the changes of the fuel quantity injected into the individual cylinders is selected such that it results in a total of zero.

In the case of an internal-combustion engine according to International Patent Document WO 97/23716, the fuel supply to a cylinder can be cut off. The cylinder will then operate, for example, as a compressor. In order to avoid vibrations in this method of operation, the fuel supply to the remaining, normally operating cylinders is changed in the appropriate manner. It is possible to determine by experiments and calculation in which manner the torque of the cylinders is to be distributed in order to achieve an optimal suppression of vibrations. For certain operations, determined data are kept available in this manner according to which the internal-combustion engine is controlled. The injection quantities are obviously distributed to the individual cylinders such that the vibrations of the 0.5th to 3rd orders are suppressed because only they are responsible for noticeable vibrations in practice. However, the vibrations of the various orders can obviously not always be suppressed to the same extent. The appropriate fuel distribution is obviously related to the size of the vector which is responsible for the vibrations.

A method for the cylinder-selective control of a compression ignition internal-combustion engine is known also from International Patent Document WO 98/07971. In this case, a measuring device is known for detecting the angle of rotation of the crankshaft and for determining the momentary rotational speed of the crankshaft. From the rotational speed of the crankshaft, a control unit determines suitable parameters which permit, in various operating ranges of the internal-combustion engine, a cylinder-selective equalization or a defined inequalization of the mean pressures, in which case the effects of the component differences of the fuel supply and of the combustion system on the combustion process are minimized.

In a dissertation by Jochen Tonndorf, "Influence of the Misfire Operation on the Torsional Vibration Behavior of Driving Systems with Piston Engines", authorized by the Mechanical Engineering Department of the Technical University of Rheinland-Westfalen in Aachen, the torsional vibration behavior of engines is studied. It is stated there that operating conditions exist which differ significantly from the normal operation. Thus, tolerance-caused manufacturing differences in a cylinder and the injection system and also deviations caused by wear in the course of the operating duration lead to differences in comparison to the normal operation. As a result, performance deviations of the individual cylinders of approximately +/−10% can supposedly be caused, which results in generation of a torsional vibration exciting force. In multi-cylinder engines, deviations of the individual cylinders may add up so unfavorably that the effect is the same as that of a complete failure of a cylinder. Furthermore, disturbances in the injection system may result in a misfire operation. Damaged inlet or outlet valves may result in a loss of compression. The cut-off of cylinders also represents an operating instance which changes the torsional vibration strain. The effect of the operating conditions deviating from the normal operation on the excitation behavior of the engine is illustrated by a vector representation of the exciter forces. Furthermore, it is stated that, in the misfire operation, only the exciting forces of the 0.5th, 1st and 1.5th order are of interest. The exciting alternating torque is computed from the vector sum corresponding to the phase position of the harmonic. However, the author reaches the conclusion that interventions at the engine, for example by changing the ignition pressure, cannot be carried out in practice.

It is an object of the invention to illustrate a smooth-running control, particularly for internal-combustion engines with high cylinder numbers.

While, in the case of internal-combustion engines with a few cylinders, the rotational speed fractions resulting from the individual cylinders can clearly be detected in the rotational speed curve of an operating cycle, this is not so in the case of internal-combustion engines with large cylinder numbers. On the contrary, the rotational speed fractions are superimposed such that, when viewing the rotational speed curve, conclusions can no longer be drawn with respect to the provoking cylinder, which requires new analyzing methods. Nevertheless, the inventive method can also be applied to internal-combustion engines with a low number of cylinders, although limitations exist there because of the low number of cylinders. For smooth-running control, the low-frequency vibration fractions are considered here. For this purpose, the pulse response spectrum of each cylinder is determined by calculation or measurement. For determining the pulse fraction of a cylinder from the rotational speed by measuring, the cylinders are individually cut off successively and the rotational speed is recorded above the crank angle. In addition, the rotational speed course of the healthy intact engine, that is, when all cylinders are operating normally, is recorded. This may be a new engine directly from the factory in normal operation which, because of tolerances, has slight differences in the rotational speed fractions of each cylinder, or it may be an ideal engine whose cylinders are equalized, for example, by using the method according to the invention, with respect to their fractions in the rotational speed acceleration.

"Ideal" in this sense means that, before recording the reference values, an adjustment is carried out, for example, by varying the injection quantities of individual cylinders. During this adjustment, the fluctuations of the rotational speed contributions of the cylinders are minimized. This adjustment is maintained in the normal operation. By forming the difference between the course of curve of the healthy engine and of the courses of the curves for individually cut-off cylinders, new curves are generated which reflect the influence of each cylinder on the overall rotational speed course. These response curves are subjected to a Fourier decomposition. However, only low-frequency harmonic vibrations, expediently of the 0.5th to 3rd order, are considered, and the pertaining spectral pulse responses $\vec{I}$ of the rotational speed course of an operating cycle of each cylinder are recorded. In the normal engine operation, the rotational speed course of the crankshaft is now entered continuously above the angle, and analogously, by means of a Fourier decomposition of the obtained course of the curve, the spectrum $\vec{R}$ of an operating cycle is formed. For illustrating the spectral rotational speed course again only the Fourier coefficients of the low-frequency vibrations are used, specifically preferably of the harmonics of the 0.5th to 3rd order which are processed to form a row matrix. The spectral pulse responses $\vec{I}$ and the resultant $\vec{R}$ of Fourier coefficients of the rotational speed course can be illustrated for each harmonic as a vector indicator above the crank angle. When the resultant is equal to zero, no correction of the injection quantities is required. However, when a resultant is present, this means that an insufficient injection is taking place in a cylinder, and, as a result of the correction of the injection quantities of the individual injectors, the resultant must be changed to zero. The distribution of the total injection quantity required for the given load case takes place such that the components of the resultant situated in the direction of the pulse response indicator are multiplied by the pulse responses $\vec{I}$. The result is correction factors for the injection quantities. Cylinders which are situated in the direction of the resultant $\vec{R}$ are more corrected by means of positive or negative signs than those situated more orthogonally. The mathematical operation, which can accomplish the corresponding task is the formation of the scalar product or of the vectorial inproduct from the resultant $\vec{R}$ and the spectral pulse responses $\vec{I}$. For this purpose, the required data are held available in matrix form. The matrix multiplication of the pulse responses $\vec{I}$ with the vector of the spectral rotational speed course $\vec{R}$ results in values different from zero and leads to a correction of the injection quantities when a smooth running deviation exists in the normal operation. The correction values, which are normalized, are supplied to a governor and the injection quantities $\Delta Q$ are determined, which may be positive or negative, and correspondingly correct the injection quantities for each injector of a cylinder determined by the engine governor.

DESCRIPTION OF THE DRAWINGS

The invention is illustrated by means of the drawings containing FIGS. 1 to 4.

DETAILED DESCRIPTION OF THE INVENTION

Figure 1:
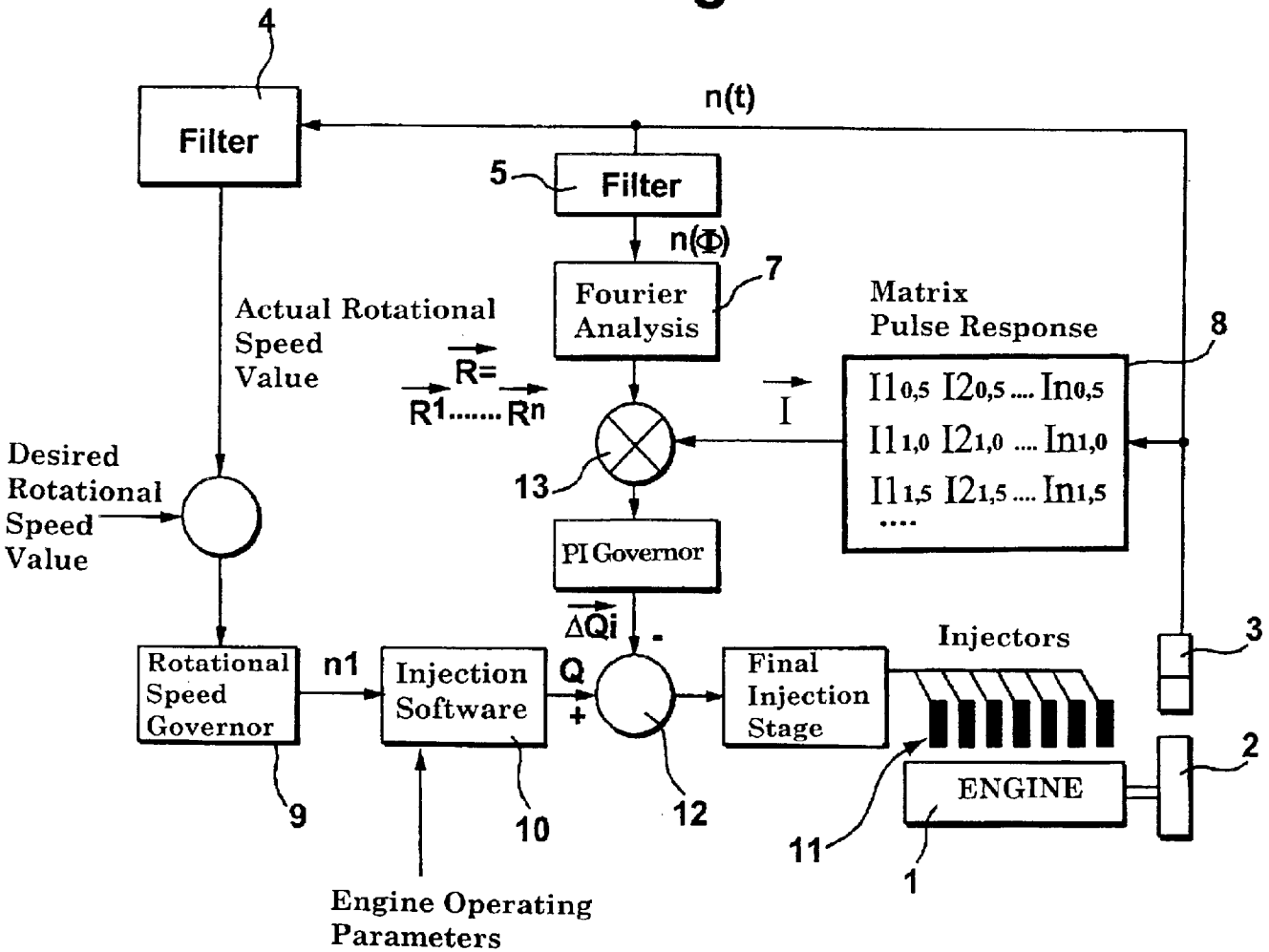
FIG. 1 is a schematic representation of a rotational speed control circuit with the elements required for torsional vibration analysis.
Figure 2:
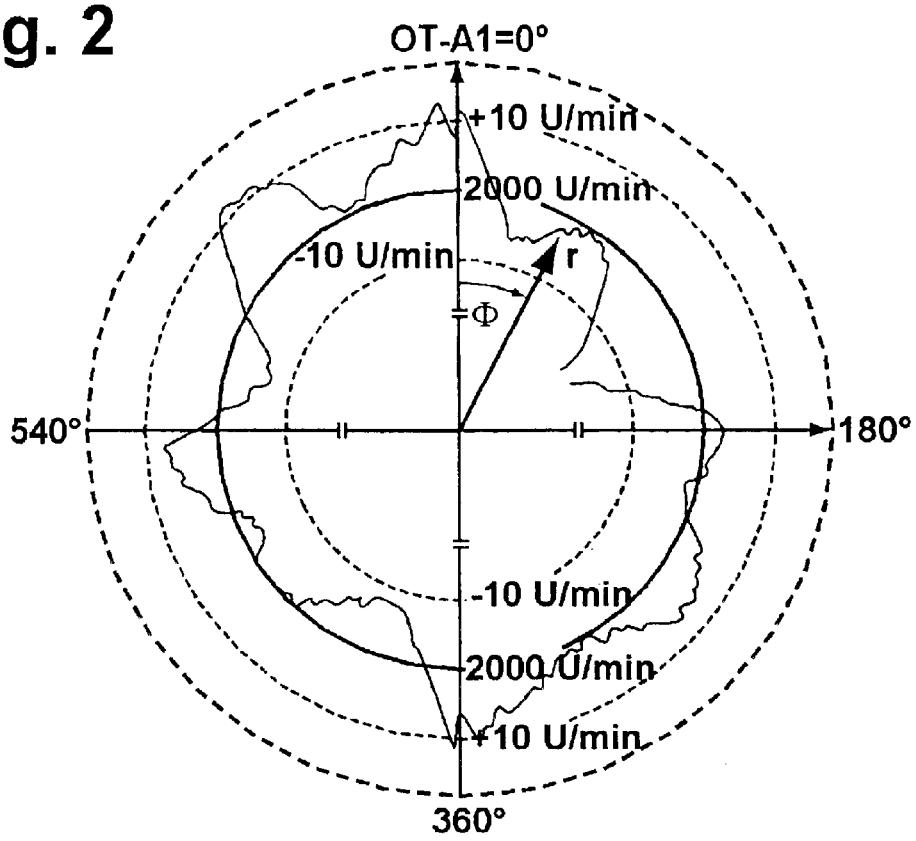
FIG. 2 is a view of the rotational speed course of the crankshaft above the angle for an operating cycle of the engine.
Figure 4A:
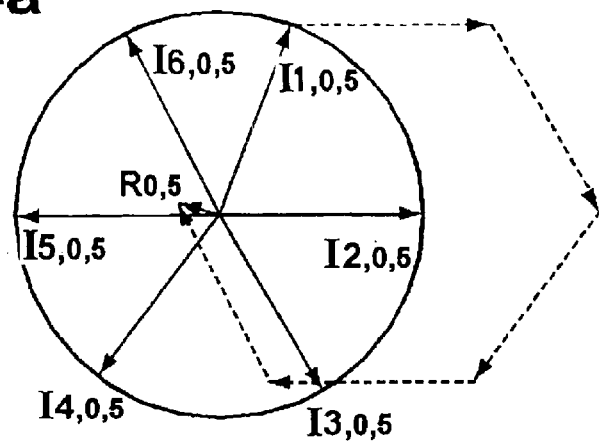
FIGS. 4*a*–4*c* are indicator representations of the rotational speed fractions of the cylinder of the 0.5th order for a six-cylinder engine, specifically for a healthy engine (FIG. 4*a*), an engine with a injector (FIG. 4*b*), and an engine with a corrected injection quantity (FIG. 4*c*).

FIG. 1 illustrates a rotational speed control circuit, as known, for example, from German Patent Document DE 195 15 481 A1. Reference number 1 indicates a diesel engine whose not shown crankshaft is connected with a measuring wheel 2. By means of the measuring wheel 2 and a transducer 3, the rotational speed course of the crankshaft can be recorded above the angle. By means of a filter 4 and a filter 5, disturbances are extracted and an averaging of the course of the curve is carried out in that the recorded courses of the curves are adjusted over several operating cycles. For a smooth running control, in the normal engine operation, the rotational speed course of the crankshaft is continuously recorded above the angle. The rotational speed signal of a working cycle is illustrated as an example in FIG. 2. The radius marked r corresponds to the momentary rotational speed at the angle $\phi$. The rotational speed course shows a deformation as it occurs in the event of a failure of a cylinder. By means of a Fourier decomposition of the curve of the rotational speed course, the spectral rotational speed course is obtained with the resulting vectors $\vec{R}_1$ to $\vec{R}_n$, the indexes corresponding to the considered harmonic waves. The corresponding operation is implemented in the symbolically illustrated function block 7. The vectors $\vec{R}$ obtained by the Fourier decomposition are the Fourier coefficients. Preferably, only the harmonic vibrations of the 0.5th to 3rd order are considered. In the case of ideal smooth running, no resulting fractions of the corresponding harmonic will occur, or these fractions are at least negligible. However, there is in fact a low resulting vector $\vec{R}$ because the harmonic wave fractions are not uniformly distributed along the circumference. For an engine with six cylinders, this case is illustrated as an example with respect to the harmonic of the 0.5th order in FIG. 4*a*. Each cylinder makes approximately the same contribution to the rotational acceleration, as indicated by the vector indicators $\vec{I}$1 to $\vec{I}$6. In this case, no correction of the injection quantities, determined on the basis of the defined desired and actual rotational speeds in the rotational speed governor 9 and by the injection software 10 by the injectors 11 assigned to each cylinder, takes place.

Figure 4B:
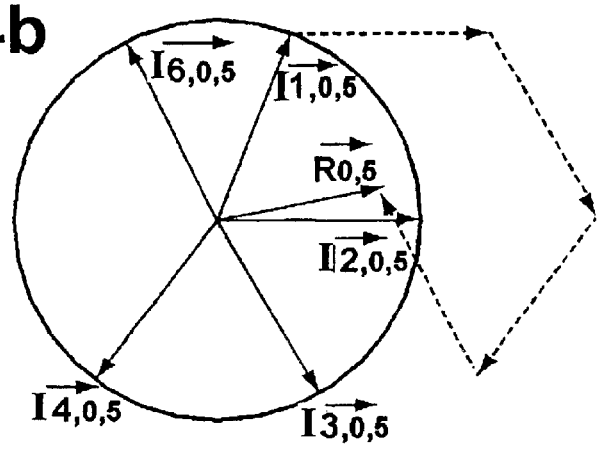

However, the injection quantity must be corrected individually for each cylinder if, as illustrated in FIG. 4*b*, a resultant $\vec{R}$ based on the low-frequency vibration fractions is not equal to zero. In the corresponding case, it is assumed that a cylinder has failed and a harmonic occurs of the 0.5th order which has the illustrated phase position with respect to the cylinders.

Figure 3:
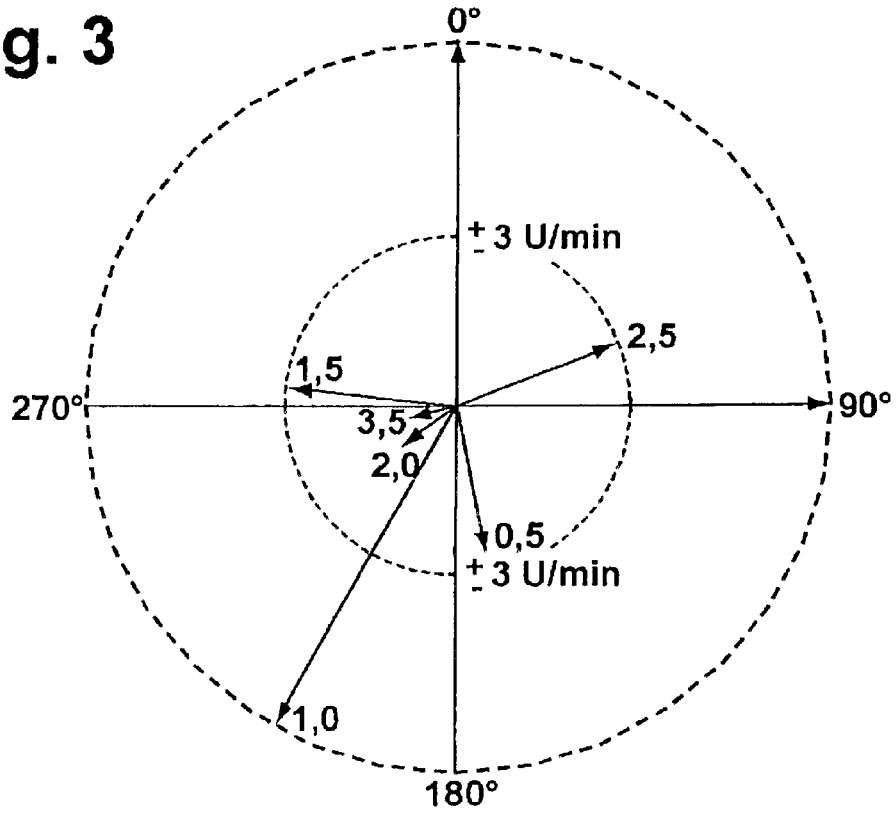
FIG. 3 is a spectral representation of the pulse response $\dot{i}$ of a cylinder.
Figure 4C:
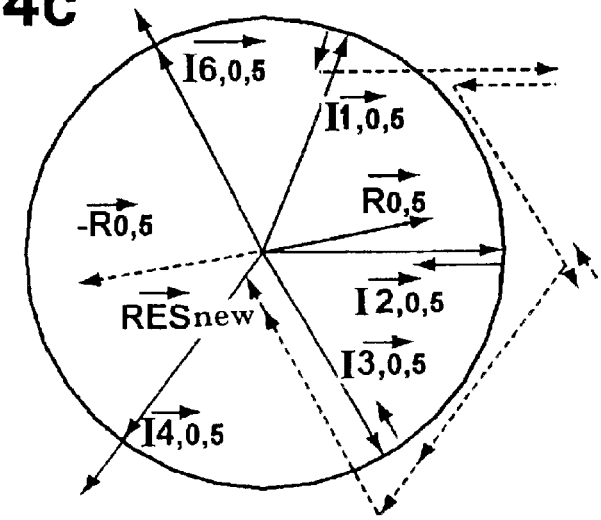

In order to be able to compute correction factors for the injection quantities of the injectors suitable for establishing the smooth running, the pulse fraction of each cylinder in the rotational speed must be known. The corresponding rotational-speed dependent data are held available in the function block 8. For determining the pulse fraction of a cylinder in the rotational speed, the cylinders are individually cut off successively in a measuring run and the rotational speed is recorded above the crank angle. By means of a comparison with the rotational speed course of the healthy engine, new courses of the curves are obtained from the difference between the two curve courses, which new courses represent the pulse responses $\vec{I}$ of the engine to the cutting-off of the cylinders. The pulse responses $\vec{I}$ are subjected to a Fourier transformation, in which case the spectral pulse responses $\vec{I}$ are obtained. Only those fractions are considered which are based on the low-frequency harmonic vibrations of the 0.5th to 3rd order. The spectral pulse response $\vec{I}=(\vec{I}_{0.5}, \vec{I}_{1.0}, \vec{I}_{1.5}, \vec{I}_{2.0}, \vec{I}_{2.5}, \vec{I}_{3.0})$ of a cylinder is illustrated in FIG. 3. The vector indicators illustrate the amount and the phase of the corresponding harmonic. The pulse responses $\vec{I}$ are filed in matrix form for [the] mathematical processing. By forming the scalar inproduct of the resulting vectors $\vec{R}$ with the pulse responses $\vec{I}$, correction factors are generated for the injection quantities of the individual injectors. This takes place at the multiplication point 13. The scalar vector product has the effect that only the components of the resultant $\vec{R}$ situated in the direction of the pulse response vectors make a contribution to the correction factors; that is, collinear vectors are corrected considerably and orthogonal vectors are not corrected at all. In FIG. 4*c*, the correction values are shown as vector arrows for the individual injectors. The correction factors are converted by multiplication with a constant factor into injection quantities ΔQ, which may be positive or negative, and correspondingly the injection quantity Q defined by the engine governor for each injector of a cylinder is positively or negatively corrected in a summation point 12.

The computation takes place according to the following equations:

Formation of the scalar product:

$$\vec{R}^T * \vec{I} = K \text{ or:}$$

$$\left(\vec{R}_{0,5} \quad \vec{R}_{1,0} \quad \vec{R}_{1,5} \quad \vec{R}_{2,0} \quad \vec{R}_{2,5} \quad \ldots\right) * \begin{pmatrix} \vec{I}1_{0,5}, \vec{I}2_{0,5}, \vec{I}3_{0,5}, \vec{I}4_{0,5}, \ldots \\ \vec{I}1_1, \vec{I}2_1, \vec{I}3_1, \vec{I}4_1, \ldots \\ \vec{I}1_{1,5}, \vec{I}2_{1,5}, \vec{I}3_{1,5}, \vec{I}4_{1,5}, \ldots \\ \vec{I}1_2 \ldots \end{pmatrix} = \left(K1 \quad K2 \quad K3 \quad \ldots\right)$$

$\vec{R}^T$=spectrum of the rotational speed course of an operating cycle (transposed)

$\vec{I}$=spectral pulse responses

K=correction factors for the injection quantity

By multiplying the scalar quantity K with the unit vector $\vec{e}_I$ of the pulse response, $\vec{K}$ is obtained:

$$\vec{K}=K*\vec{e}_I$$

What is claimed is:

1. A method of controlling smooth running of a crankshaft of an internal-combustion engine, in which contributions of individual cylinders of the internal-combustion engine to rotational acceleration are determined by a rotational speed course of the crankshaft and in which injection quantities of injectors assigned to the cylinders are varied for adjusting defined rotational speed contributions to the rotational speed course, comprising:

forming a pulse response spectrum $\vec{I}$ of an operating cycle at least for the harmonic of the 0.5th order based on computed or measured rotational speed curves of the crankshaft, recording, in normal operation, in each case, the rotational speed course of the crankshaft above an angle of an operating cycle recorded and determining, by a Fourier transformation, the Fourier coefficients as a resultant $\vec{R}$ at least of the harmonic of the 0.5th order, and obtaining correction factors for the injection quantities of the individual cylinders, the components of the resultant $\vec{R}$ situated in the direction of the pulse response vectors being multiplied with the pulse response spectrum $\vec{I}$ and combined by an addition.

2. The method of controlling smooth running according to claim 1, wherein the pulse response spectrum $\vec{I}$ is obtained from a difference between a rotational speed curve of a healthy engine and a rotational speed curve of an engine with one cut-off cylinder respectively for each cylinder by a Fourier transformation of a rotational speed difference curve.

3. The method according to claim 1, wherein a scalar product is formed from the pulse response spectrum $\vec{I}$ and the Fourier coefficients determined as the resultant $\vec{R}$, elements of the scalar product, after multiplication with a unit vector, representing the correction factors for the injection quantities of each cylinder with respect to amount and direction.

4. The method according to claim 1, wherein low-frequency fractions of several harmonic waves are averaged from courses of curves by a Fourier transformation and correction factors are indicated therefrom for the injection quantities of each cylinder.

5. The method according to claim 4, wherein harmonic waves of the 0.5th to the 3rd order are considered.

6. The method according to claim 4, wherein the Fourier coefficients used are of the 0.5th and 1st order.

7. The method according to claim 5, wherein harmonic waves of the 1.5th order are also considered.

8. The method according to claim 1, wherein the coefficients of the Fourier transformation are filed and processed as matrices in a vehicle computer.

9. The method according to claim 1, wherein adjustment of the injection quantities of the individual cylinders of the healthy engine is corrected until contributions of the cylinders, at least as far as low-frequency harmonics are concerned, are largely equalized for the rotational acceleration, and wherein, in comparison to the rotational speed course, contributions of the individual cylinders to the rotational speed course are determined.

10. The method according to claim 2, wherein a scalar product is formed from the pulse response spectrum $\vec{I}$ and the Fourier coefficients determined as the resultant $\vec{R}$, elements of the scalar product, after multiplication with a unit vector, representing the correction factors for the injection quantities of each cylinder with respect to amount and direction.

11. The method according to claim 2, wherein low-frequency fractions of several harmonic waves are averaged from courses of curves by a Fourier transformation and correction factors are indicated therefrom for the injection quantities of each cylinder.

12. The method according to claim 3, wherein low-frequency fractions of several harmonic waves are averaged from courses of curves by a Fourier transformation and correction factors are indicated therefrom for the injection quantities of each cylinder.

13. The method according to claim 11, wherein harmonic waves of the 0.5th to the 3rd order are considered.

14. The method according to claim 12, wherein harmonic waves of the 0.5th to the 3rd order are considered.

15. The method according to claim 11, wherein the Fourier coefficients used are of the 0.5th and 1st order.

16. The method according to claim 12, wherein the Fourier coefficients used are of the 0.5th and 1st order.

17. The method according to claim 13, wherein harmonic waves of the 1.5th order are also considered.

18. The method according to claim 14, wherein harmonic waves of the 1.5th order are also considered.

19. The method according to claim 2, wherein the coefficients of the Fourier transformation are filed and processed as matrices in a vehicle computer.

20. The method according to claim 3, wherein the coefficients of the Fourier transformation are filed and processed as matrices in a vehicle computer.

21. The method according to claim 4, wherein the coefficients of the Fourier transformation are filed and processed as matrices in a vehicle computer.

22. The method according to claim 5, wherein the coefficients of the Fourier transformation are filed and processed as matrices in a vehicle computer.

23. The method according to claim 6, wherein the coefficients of the Fourier transformation are filed and processed as matrices in a vehicle computer.

24. A The method according to claim 7, wherein the coefficients of the Fourier transformation are filed and processed as matrices in a vehicle computer.

25. The method according to claim 2, wherein adjustment of the injection quantities of the individual cylinders of the healthy engine is corrected until contributions of the cylinders, at least as far as low-frequency harmonics are concerned, are largely equalized for the rotational acceleration, and wherein, in comparison to the rotational speed course, contributions of the individual cylinders to the rotational speed course are determined.

26. The method according to claim 3, wherein adjustment of the injection quantities of the individual cylinders of the healthy engine is corrected until contributions of the cylinders, at least as far as low-frequency harmonics are concerned, are largely equalized for the rotational acceleration, and wherein, in comparison to the rotational speed course, contributions of the individual cylinders to the rotational speed course are determined.

27. The method according to claim 4, wherein adjustment of the injection quantities of the individual cylinders of the healthy engine is corrected until contributions of the cylinders, at least as far as low-frequency harmonics are concerned, are largely equalized for the rotational acceleration, and wherein, in comparison to the rotational speed course, contributions of the individual cylinders to the rotational speed course are determined.

28. The method according to claim 5, wherein adjustment of the injection quantities of the individual cylinders of the healthy engine is corrected until contributions of the cylinders, at least as far as low-frequency harmonics are concerned, are largely equalized for the rotational acceleration, and wherein, in comparison to the rotational speed course, contributions of the individual cylinders to the rotational speed course are determined.

29. The method according to claim 6, wherein adjustment of the injection quantities of the individual cylinders of the healthy engine is corrected until contributions of the cylinders, at least as far as low-frequency harmonics are concerned, are largely equalized for the rotational acceleration, and wherein, in comparison to the rotational speed course, contributions of the individual cylinders to the rotational speed course are determined.

30. The method according to claim 7, wherein adjustment of the injection quantities of the individual cylinders of the healthy engine is corrected until contributions of the cylinders, at least as far as low-frequency harmonics are concerned, are largely equalized for the rotational acceleration, and wherein, in comparison to the rotational speed course, contributions of the individual cylinders to the rotational speed course are determined.

31. The method according to claim 8, wherein adjustment of the injection quantities of the individual cylinders of the healthy engine is corrected until contributions of the cylinders, at least as far as low-frequency harmonics are concerned, are largely equalized for the rotational acceleration, and wherein, in comparison to the rotational speed course, contributions of the individual cylinders to the rotational speed course are determined.

* * * * *